US010053811B2

(12) United States Patent
Kim et al.

(10) Patent No.: US 10,053,811 B2
(45) Date of Patent: Aug. 21, 2018

(54) WASHING MACHINE

(71) Applicant: SAMSUNG ELECTRONICS CO., LTD., Suwon-si, Gyeonggi-do (KR)

(72) Inventors: Jae Young Kim, Suwon-si (KR); Nae Young Park, Seoul (KR); Min Jea Choi, Suwon-si (KR); Zoo Hyeong Kim, Suwon-si (KR); Jang Hoon Park, Suwon-si (KR); Kwang Min Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 75 days.

(21) Appl. No.: 15/202,883

(22) Filed: Jul. 6, 2016

(65) Prior Publication Data

US 2017/0183803 A1 Jun. 29, 2017

(30) Foreign Application Priority Data

Dec. 24, 2015 (KR) ..... 10-2015-0186720

(51) Int. Cl.
*D06F 37/00* (2006.01)
*D06F 37/28* (2006.01)
(Continued)

(52) U.S. Cl.
CPC ..... *D06F 37/28* (2013.01); *D06F 37/10* (2013.01); *D06F 39/14* (2013.01); *E06B 3/5045* (2013.01); *E06B 5/00* (2013.01)

(58) Field of Classification Search
CPC ..... D06F 37/28; D06F 37/10; D06F 37/18; D06F 37/14
See application file for complete search history.

(56) References Cited

U.S. PATENT DOCUMENTS 1,549,965 A * 8/1925 Everett ..... D06F 37/10 68/139
8,844,328 B2 * 9/2014 Loss ..... D06F 37/28 312/326
(Continued)

FOREIGN PATENT DOCUMENTS

DE 2 244 751 3/1974
EP 1 389 643 A2 2/2004
(Continued)

OTHER PUBLICATIONS

Extended European Search Report dated Nov. 2, 2016 in corresponding European Patent Application No. 16177251.2.

*Primary Examiner* — Daniel J Rohrhoff
(74) *Attorney, Agent, or Firm* — Staas & Halsey LLP

(57) ABSTRACT

Disclosed herein are a washing machine, which includes a main body in which a main entrance is formed at a front thereof, a tub that is provided inside the main body, and a main door that is coupled to the main body to open and close the main entrance and includes a glass member and a holder member. The glass member includes a flange portion that is coupled to the holder member, and a body portion that protrudes toward an inside of the tub and has an auxiliary entrance formed therein for inputting laundry to the inside of the tub while the main door is closed. With this configuration, opening the auxiliary door and additionally inputting laundry is possible during a washing cycle.

13 Claims, 12 Drawing Sheets

(51) Int. Cl.

| | |
|---|---|
| ***E06B 3/50*** | (2006.01) |
| ***E06B 5/00*** | (2006.01) |
| ***D06F 39/14*** | (2006.01) |
| ***D06F 37/10*** | (2006.01) |

(56) References Cited

U.S. PATENT DOCUMENTS

| | | | | |
|---|---|---|---|---|
| 2005/0034486 | A1* | 2/2005 | Bienick | D06F 39/14<br>68/3 R |
| 2015/0211167 | A1* | 7/2015 | Kim | D06F 31/00<br>68/140 |
| 2015/0292135 | A1* | 10/2015 | Wishney | D06F 39/14<br>68/139 |
| 2016/0369445 | A1* | 12/2016 | Kim | D06F 39/14 |

FOREIGN PATENT DOCUMENTS

| | | | |
|---|---|---|---|
| EP | 1 389 643 | A3 | 9/2004 |
| EP | 2 930 263 | A1 | 10/2015 |

* cited by examiner

WASHING MACHINE

CROSS-REFERENCE TO RELATED APPLICATION

This application claims the benefit of Korean Patent Application No. 10-2015-0186720, filed on Dec. 24, 2015 in the Korean Intellectual Property Office, the disclosure of which is incorporated herein by reference.

BACKGROUND

1. Field

Embodiments of the present invention relate to a washing machine, and more particularly, to a washing machine capable of inputting laundry during a washing cycle without opening a main door.

2. Description of the Related Art

Generally, a washing machine is a home appliance that washes clothes using electric power, and can be categorized into a drum type washing machine that washes laundry by lifting and dropping the laundry as a rotating tub rotates, and a pulsator type washing machine that washes laundry using churning water generated by a pulsator when a rotating tub rotates.

The drum type washing machine includes a main body that forms the external appearance and has an entrance formed at the front thereof, a tub that is installed in the main body and holds wash water, a drum that is rotatably installed in the tub and washes laundry, a driving motor that is disposed behind the tub and rotates the drum, and a door installed in the main body and is configured to open and close the entrance at the front side of the main body.

As the door of the drum type washing machine is provided at the front side of the main body, it is difficult to open the door or put in additional laundry during a washing cycle.

SUMMARY

Therefore, it is an aspect of the present invention to provide a washing machine that is capable of inputting laundry during a washing cycle.

It is another aspect of the present invention to provide a washing machine having an auxiliary entrance, which is formed at a glass member of a main door for inputting laundry during a washing cycle.

It is still another aspect of the present invention to provide a washing machine having an auxiliary door which opens and closes an auxiliary entrance.

It is yet another aspect of the present invention to provide a washing machine, in which an auxiliary door is coupled to a glass member.

Additional aspects of the invention will be set forth in part in the description which follows and, in part, will be obvious from the description, or may be learned by practice of the invention.

In accordance with one aspect of the present invention, a washing machine may include a main body in which a main entrance is formed at a front side; a tub provided inside the main body; and a main door that is coupled to the main body to open and close the main entrance. And, the main door may include a glass member and a holder member that is coupled to an edge portion of the glass member to support the glass member. Further, the glass member may include a flange portion that is coupled to the holder member, and a body portion that protrudes toward an inside of the tub and has an auxiliary entrance formed therein for inputting laundry to the inside of the tub while the main door is closed.

The washing machine may include an auxiliary door which opens and closes the auxiliary entrance.

The auxiliary door may be rotatably provided.

The washing machine may include a frame unit that is coupled to the auxiliary entrance.

The frame unit may include a hinge portion that rotatably supports the auxiliary door.

The frame unit may include a catch portion that keeps the auxiliary door in a closed state unless a force exceeding a predetermined level is applied to the auxiliary door.

The frame unit may include a front frame that is provided at a front side of the glass member, and a rear frame that is provided at a rear side of the glass member and is coupled to the front frame.

The washing machine may include an engaging member which couples a front frame and a rear frame together.

The washing machine may include a packing member coupled to the auxiliary entrance for sealing between the glass member and the frame unit.

The washing machine may include a locking device that locks the auxiliary door in a closed state.

The auxiliary door may include a sealing member that is provided for making a sealing contact with the frame unit.

The body portion may include a slanted upper portion, a slanted lower portion, and an intermediate portion that is vertically provided therebetween.

The auxiliary entrance may be formed at the intermediate portion.

The washing machine may include a hinge member that is coupled to the glass member so as to rotatably support the auxiliary door.

A through hole may be formed at the glass member to be coupled with the hinge member.

In accordance with another aspect of the present, a washing machine may include a main body in which a main entrance is formed at a front side; a tub provided in the main body; and a main door that is coupled to the main body to open and close the main entrance and includes a glass member in which an auxiliary entrance is formed for inputting laundry to an inside of the tub; and an auxiliary door that is provided to allow or block an access to the auxiliary entrance.

The washing machine may include a frame unit that is coupled to the auxiliary entrance.

The frame unit may include a hinge portion that rotatably supports the auxiliary door.

The washing machine may include a hinge member that is coupled to the glass member so as to rotatably support the auxiliary door.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
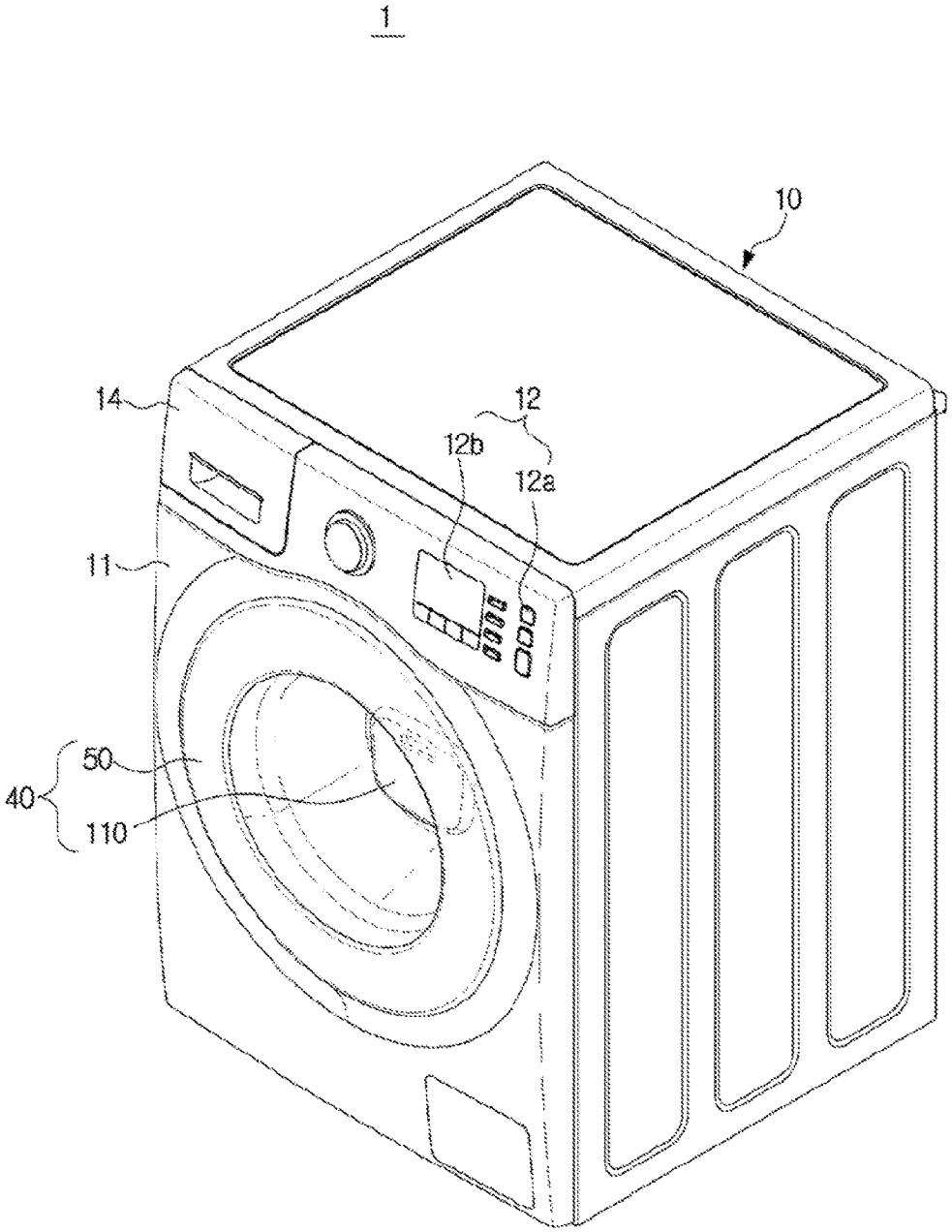
FIG. 1 is a perspective view showing an external appearance of a washing machine according to an embodiment of the invention.

Reference will now be made in detail to the embodiments of the present invention, examples of which are illustrated in the accompanying drawings, wherein like reference numerals refer to like elements throughout.

Since embodiments of the invention described in this specification are merely preferred embodiments and do not represent the entire inventive concept, it should be understood that various equivalents or modifications that may substitute these embodiments at the time of present application are included in the scope of the invention.

Like reference numbers designate like elements throughout the drawings and views in the drawings may be enlarged or exaggerated for better understanding of the inventive concept.

Unless otherwise defined, all terms (including technical and scientific terms) used herein have the same meaning as commonly understood by one of ordinary skill in the art to which this inventive concept belongs.

However, those terminologies designated otherwise in this specification should not be limited or interpreted as a normal or lexical meaning. Based on the principle that an inventor can define terminologies to give a better understanding about the invention, those terminologies may have to be interpreted as a meaning and concept according to the aspects of the inventive concept.

It should be understood that, although the terms "first," "second," etc. may be used herein to describe various elements, these elements should not be limited by these terms. These terms are only used to distinguish one element from another.

The singular forms "a," "an," and "the" are intended to include the plural forms as well, unless the context clearly indicates it as "one".

It should be understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

When an element is described simply as "in front of", "behind", "above", "below", "to the left of", or "to the right of", the referred to element is not only provided directly "in front of", "behind", "above", "below", "to the left of", or "to the right of" another element, but the case of a third element intervening therebetween is also possible.

Hereinafter, a preferred embodiment according to the present invention will be described in detail with reference to the accompanying drawings.

Figure 2:
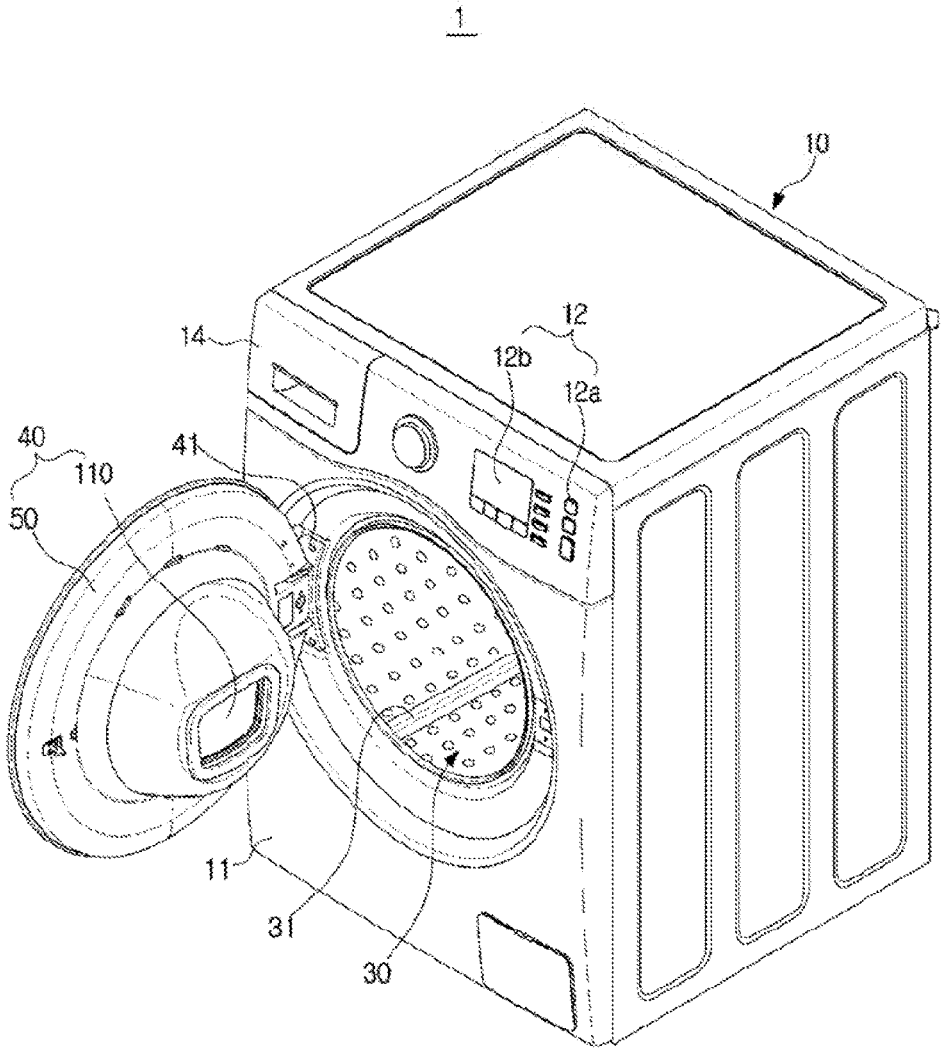
FIG. 2 is a view showing a state in which a main door of the washing machine of FIG. 1 is open.
Figure 3:
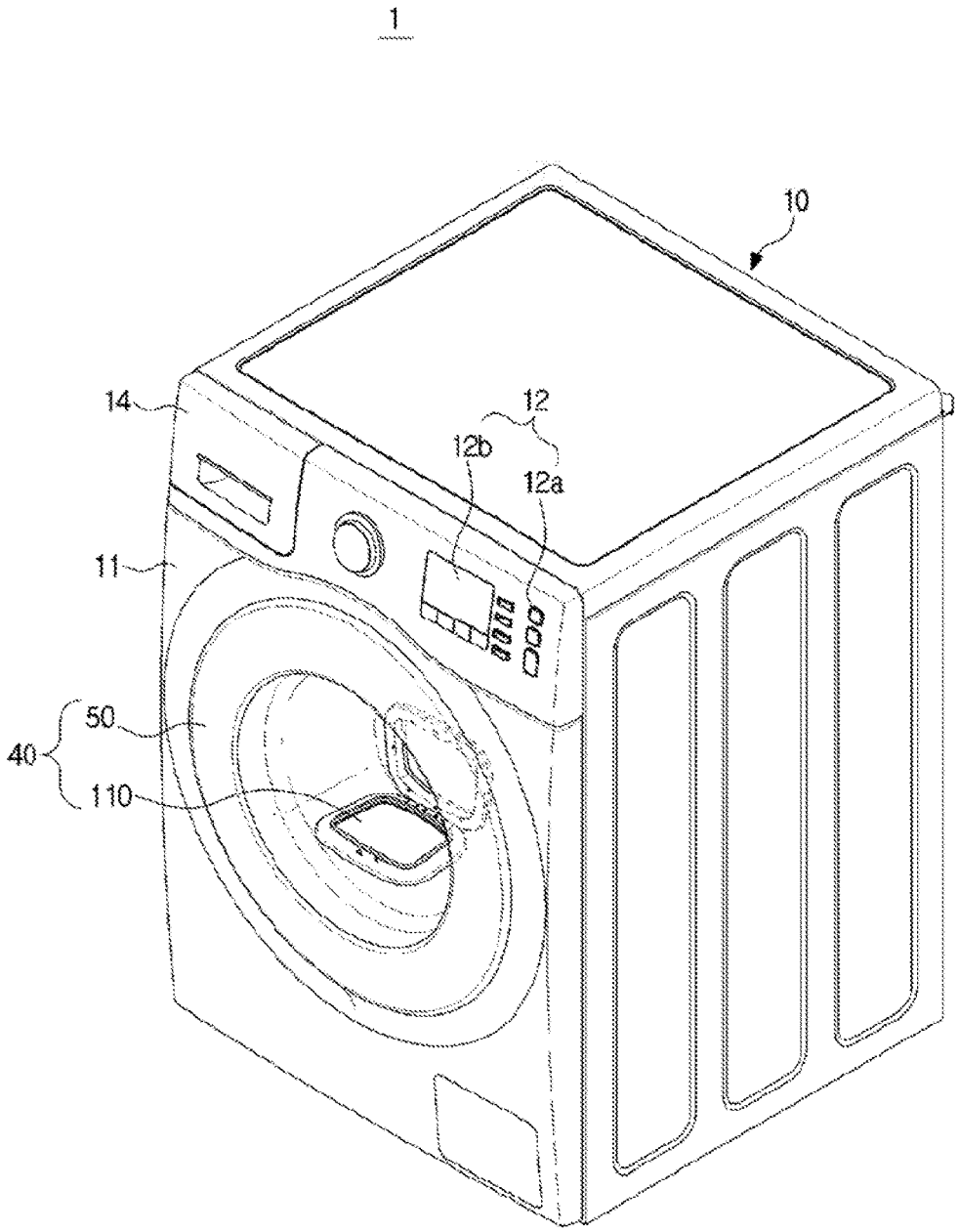
FIG. 3 is a view showing a state in which an auxiliary door is opened while the main door is closed in the washing machine of FIG. 1.
Figure 4:
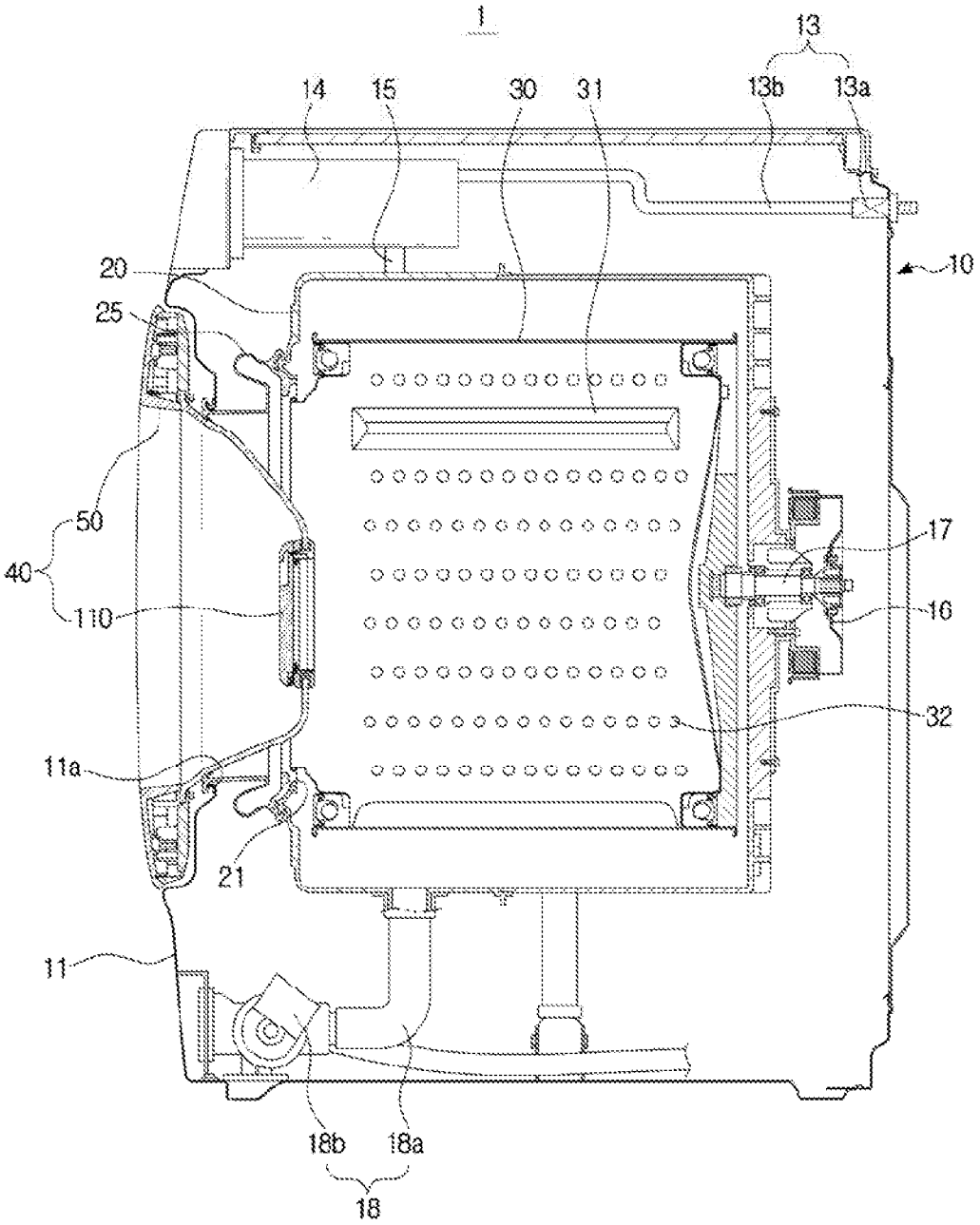
FIG. 4 is a side cross-sectional view showing a schematic configuration of the washing machine of FIG. 1.

FIG. 1 is a perspective view showing an external appearance of a washing machine according to an embodiment of the invention. FIG. 2 is a view showing a state in which a main door of the washing machine of FIG. 1 is opened. FIG. 3 is a view showing a state in which an auxiliary door is opened while the main door is closed in the washing machine of FIG. 1. FIG. 4 is a side cross-sectional view showing a schematic configuration of the washing machine of FIG. 1.

A washing machine 1 may include a main body 10 that forms an external appearance and accommodates various kinds of constituent elements, a tub 20 installed in the main body 10 to hold wash water, a drum 30 that accommodates laundry and rotates, and a driving motor 16 that drives the drum 30.

The main body 10 may have a substantially box shape. The main body 10 may have a front panel 11, a rear panel, a bottom panel and a side panel.

A control panel 12 having an input unit 12*a* that receives operating commands from a user and a display unit 12*b* that displays operating information of the washing machine 1 may be provided at the front panel 11.

A main entrance 11*a* through which laundry may be input to an inside of the drum 30 may be formed at the front panel 11. An opening 21 is formed in a front side of the tub 20 to correspond to the main entrance 11*a*.

A diaphragm 25 may be provided between the main entrance 11*a* of the front panel 11 and the opening 21 of the tub 20. The diaphragm 25 may form a path between the main entrance 11*a* of the front panel 11 and the opening 21 of the tub 20 to guide laundry input through the main entrance 11*a* to the inside of the drum 30. In addition, the diaphragm 25 may mitigate vibration transferred to the front panel 11 of the main body while the drum 30 rotates.

The tub 20 holds wash water and may be formed in a substantially cylindrical shape. The tub 20 may be fixed in the main body 10.

A water supply unit 13 may be provided above the tub 20 for supplying wash water into the tub 20. The water supply unit 13 may include a water supply pipe 13*b* for supplying wash water from an outside water source, and a water supply valve 13*a* that opens and closes the water supply pipe 13*b*.

A detergent supply unit 14 for supplying detergent into the tub 20 may be provided in a front upper portion of the main body 10. The detergent supply unit 14 may be connected to the tub 20 through a connecting pipe 15. The wash water supplied through the water supply pipe 13*b* may be supplied to an inside of the tub 20 via the detergent supply unit 14 along with detergent.

A driving motor 16 that generates rotatory power for rotating the drum 30 may be provided in a rear side of the tub 20. The driving motor 16 may include a fixed stator, and a rotor that rotates by electromagnetic interaction with the stator, and is capable of converting electric power to mechanical rotatory power.

The rotatory power generated at the driving motor 16 may be transmitted to the drum 30 through a drive shaft 17. The drive shaft 17 may be fixedly inserted into the rotor of the driving motor 16 so as to rotate together therewith, and may pass through a rear wall of the tub 20 to couple the drum 30 and the driving motor 16 together.

A drain unit 18 may be provided under the tub 20 to drain wash water inside the tub 20 to an outside of the main body 10. The drain unit 18 may include a drain pipe 18*a* that guides wash water of the tub 20 to the outside of the main body 10, and a drain pump 18*b* that pumps wash water out of the tub 20.

The drum 30 may have a substantially cylindrical shape with an open front side and be provided in the tub 20. The drum 30 may rotate inside the tub 20. The drum 30 may perform washing by lifting and dropping laundry while rotating. For this, a plurality of lifters 31 for lifting the laundry when the drum 30 rotates may be provided at an inner circumferential surface of the drum 30. A plurality of perforations 32 may be formed on a circumference of the drum 30 such that the wash water held in the tub 20 may flow therethrough.

The washing machine 1 may include a door assembly 40. The door assembly 40 may include a main door 50 that opens and closes the main entrance 11*a* of the front panel 11 of the main body, and an auxiliary door 110 that opens and closes an auxiliary entrance 73 formed in the main door 50.

The main door 50 may be rotatably coupled to the front panel 11 of the main body by a hinge member (Refer to 41 in FIG. 2). Though it will be described later, the auxiliary door 110 may be rotatably coupled to a glass member 70 of the main door 50 by a hinge portion 82 of a frame unit 80.

The main door 50 and the auxiliary door 110 may be opened and closed respectively and independently. That is, only the main door 50 may be opened as shown in FIG. 2, and only the auxiliary door 110 may be opened as shown in FIG. 3.

Particularly, as shown in FIG. 3, laundry may be additionally input even when the washing machine 1 is in a washing cycle, by only opening the auxiliary door 110 while the main door 50 is closed. For this, it is preferable that the auxiliary door 110 be provided at a higher level than a water level being held in the tub 20 in the washing cycle.

The main door 50 may be rotatably provided in a lateral direction and the auxiliary door 110 may be rotatably provided in a vertical direction.

However, unlike the present embodiment, the main door 50 and the auxiliary door 110 may be rotatably provided in a same direction. That is, rotating axes of the main door 50 and auxiliary door 110 may be parallel to each other. Further, rotating axes of the main door 50 and the auxiliary door 110 may be provided on a same straight line as each other.

Hereinafter, a detailed configuration and coupled structure of the main door 50 and the auxiliary door 110 will be described in detail.

Figure 5:
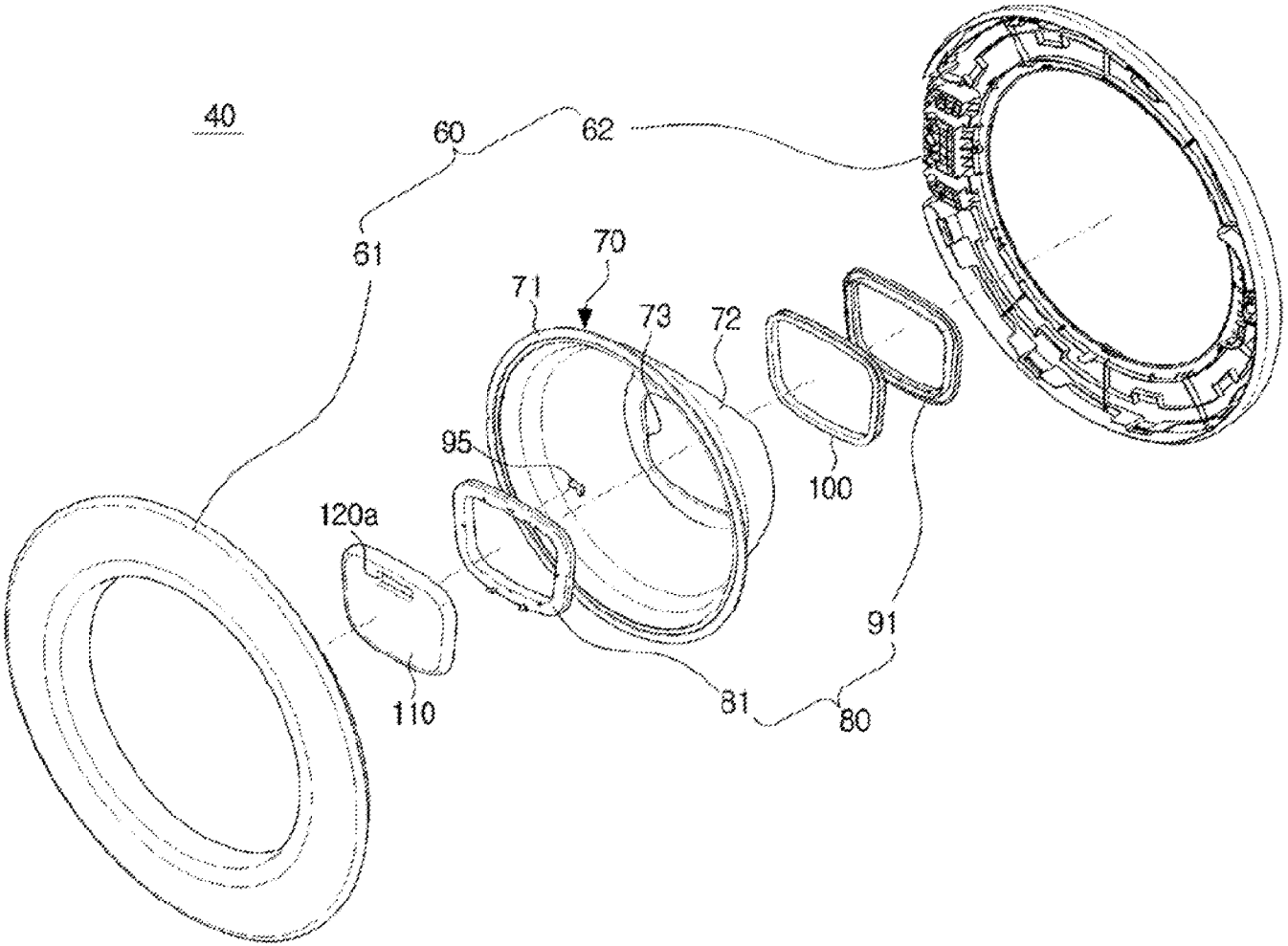
FIG. 5 is an exploded perspective view in which a door assembly of the washing machine of FIG. 1 is disassembled for illustrating a detailed configuration thereof.
Figure 6:
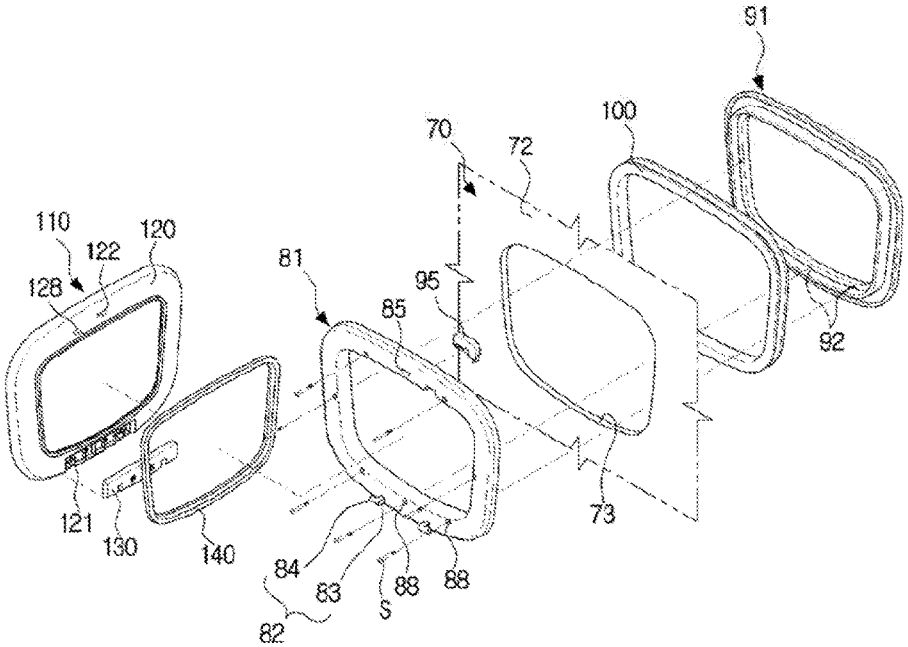
FIG. 6 is an enlarged view showing a coupled structure of the auxiliary door with a glass member in the washing machine of FIG. 1.
Figure 7:
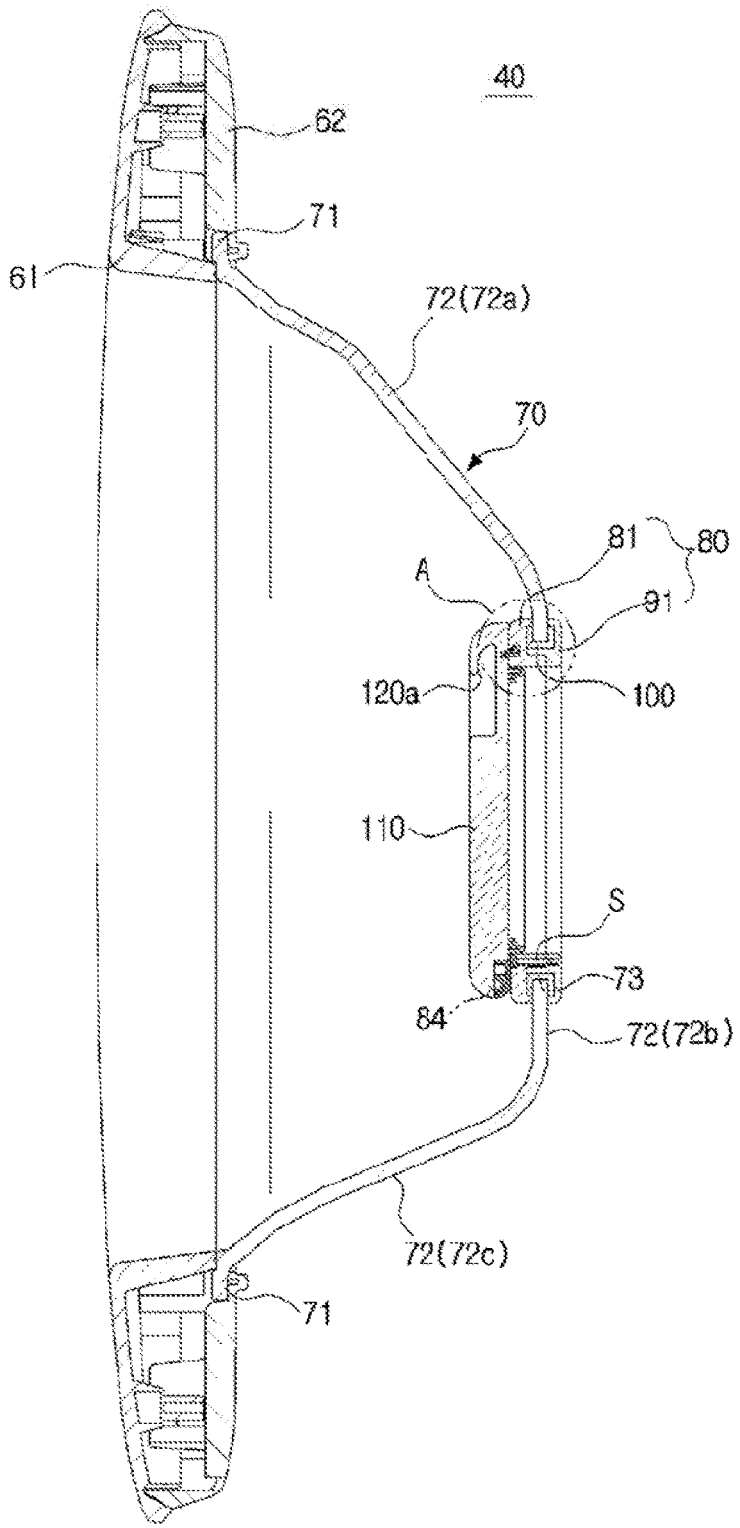
FIG. 7 is a side cross-sectional view of the door assembly of the washing machine of FIG. 1.
Figure 8:
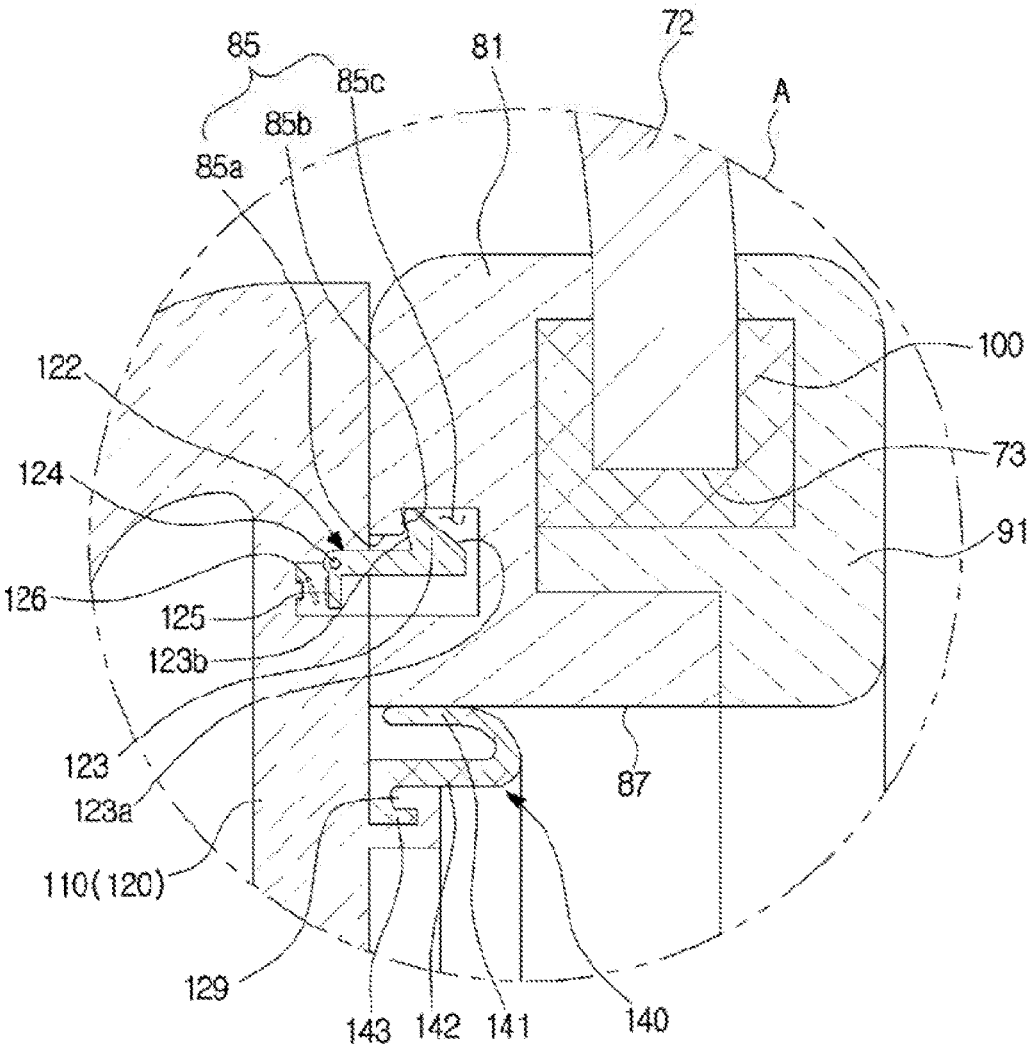
FIG. 8 is an enlarged view of region 'A' in FIG. 7.
Figure 9:
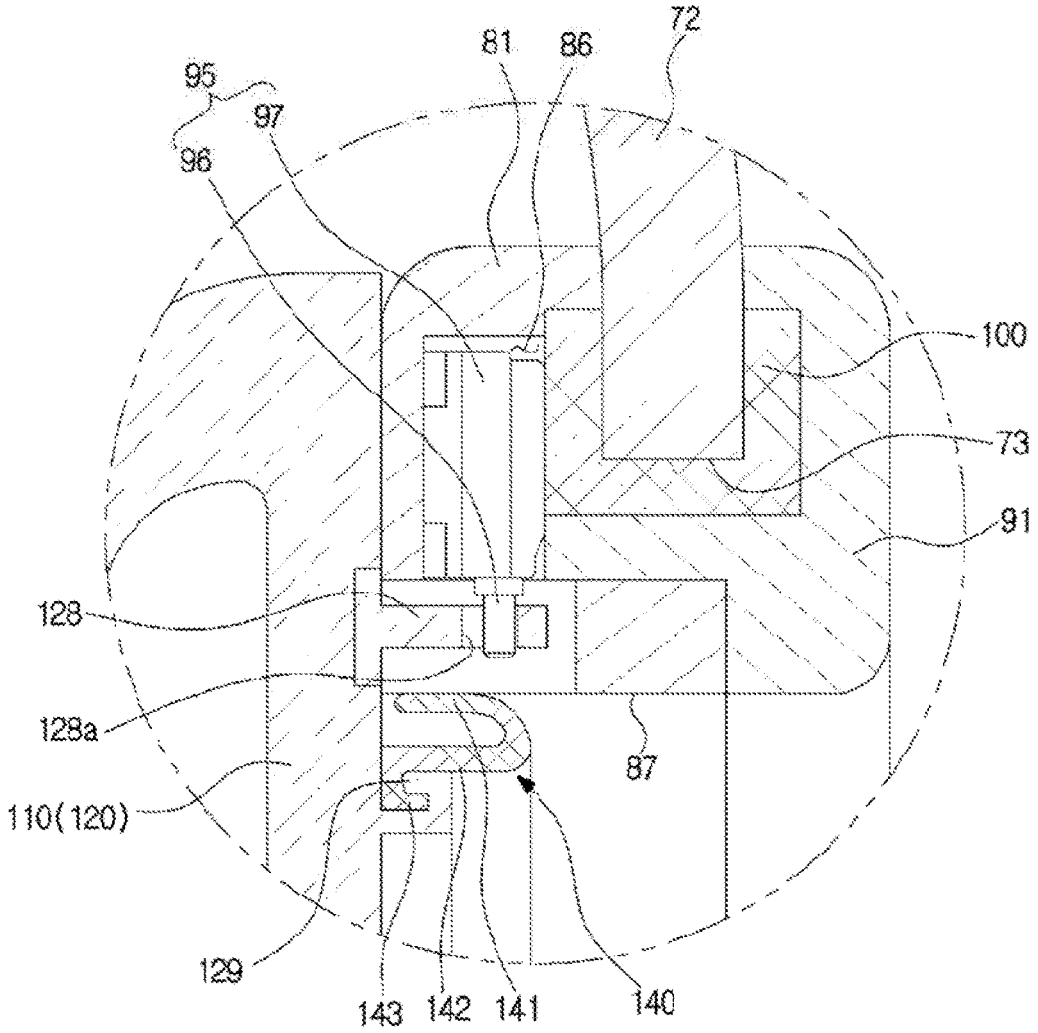
FIG. 9 is a side cross-sectional view showing a locking structure of the auxiliary door of the washing machine of FIG. 1.

FIG. 5 is an exploded perspective view in which a door assembly of the washing machine of FIG. 1 is disassembled for illustrating a detailed configuration thereof. FIG. 6 is an enlarged view showing a coupled structure of the auxiliary door with the glass member in the washing machine of FIG. 1. FIG. 7 is a side cross-sectional view of the door assembly of the washing machine of FIG. 1. FIG. 8 is an enlarged view of region 'A' in FIG. 7. FIG. 9 is a side cross-sectional view showing a locking structure of the auxiliary door of the washing machine of FIG. 1

Referring to FIGS. 5 to 9, the main door 50 may include the glass member 70, and a holder member 60 which is coupled to an edge portion of the glass member 70 to support the glass member 70.

The glass member 70 may be formed by a tempered glass material. Since tempered glass has excellent thermal and mechanical durability, it is not easily broken by an external shock or a high temperature of the wash water, and deformation may be prevented. However, the material of the glass member 70 may not be limited to tempered glass, but a plastic material having similar characteristic thereto may be used.

The glass member 70 may be formed by a transparent material such that an inside of the main body 10 may be seen.

The glass member 70 may include a flange portion 71 that is provided at the edge portion thereof so as to be coupled to the holder member 60, and a body portion 72 that protrudes from the flange portion 71 toward the inside of the tub 20 in when the main door 50 is closed.

Since the body portion 72 protrudes toward the inside of the tub 20, it prevents the laundry in the drum 30 from bunching toward the front side thereof. When the laundry is bunched and weighted toward the front side in the drum 30, it may bump against the door assembly 40 and the diaphragm 25, and the laundry and the washing machine 1 may damage each other.

The body portion 72 of the glass member 70 may closely contact the diaphragm 25 which provides a connecting passage between the main entrance 11*a* of the main body 10 and the opening 21 of the tub 20, thereby sealing the main entrance 11*a*.

Specifically, the body portion 72 of the glass member 70 may include a slanted upper portion 72*a*, a slanted lower portion 72*c*, and an intermediate portion 72*b* that is formed almost vertically therebetween. (Refer to FIG. 7)

In the body portion 72 of the glass member 70, an auxiliary entrance 73 through which laundry may be put into the drum 30 may be formed.

There is no limitation in the method of making the auxiliary entrance 73. That is, the shape of the auxiliary entrance 73 may be included when forming the glass member 70, or the auxiliary entrance 73 may be formed by extra work such as cutting, punching, or the like after first forming the glass member 70.

There is no limitation in the size of the auxiliary entrance 73, as long as it is large enough that laundry may be input. In addition, the shape of the auxiliary entrance 73 is not limited, and may have any shape such as a rectangular shape, a circular shape, an ovular shape, a tetragonal shape with round corners, or the like.

Among the upper portion 72*a*, the intermediate portion 72*b*, and the lower portion 72*c* of the body portion 72, the auxiliary entrance 73 may be formed at the intermediate portion 72*b*. Therefore, when the auxiliary door 110 that opens and closes the auxiliary entrance 73 is provided almost vertically, opening and closing the auxiliary door 110 may be convenient. However, it is not limited hereto, and the auxiliary entrance 73 may be formed at the upper portion 72*a* or at the lower portion 72*c* of the body portion 72.

The holder member 60 that supports the glass member 70 may include a front holder member 61 and a rear holder member 62. The front holder member 61 and the rear holder member 62 may each have a ring shape. The front holder member 61 and the rear holder member 62 may be coupled to each other by an engaging member such as a screw, or the like. However, unlike the present embodiment, the front holder member 61 and the rear holder member 62 may be integrally formed.

The auxiliary door 110 is provided to open and close the auxiliary entrance 73. Accordingly, the auxiliary door 110 may be formed to be the same or larger than the auxiliary entrance 73 so as to cover the auxiliary entrance 73.

The auxiliary door 110 may be rotatably coupled to the glass member 70 of the main door 50 through a frame unit 80.

The frame unit 80 may be coupled to the auxiliary entrance 73 of the glass member 70 of the main door 50. The frame unit 80 may include a front frame 81 that is provided at a front side of the glass member 70, and a rear frame 91 that is provided at a rear side of the glass member 70. The front frame 81 and the rear frame 91 may each be a ring shape and be provided corresponding to each other.

The front frame 81 and the rear frame 91 may be coupled together by engaging through a separate engaging member S. The engaging member S may include a screw, a bolt, a pin, a rivet or the like. The engaging member S may engage from the front frame 81 toward the rear frame 91. For this, at least one through hole 88 may be formed at the front frame 81 for the engaging member S to pass through, and at least one engaging hole 92 may be formed at the rear frame 91 for the engaging member S to engage with.

Alternatively, instead of the engaging through the engaging member S, the front frame 81 and the rear frame 91 may be coupled by a coupled structure of their own fitting, by an adhesive member, by thermal fusing, by ultrasonic fusing, or the like.

The front frame 81 and the rear frame 91 may be formed of a plastic or metal material for an easier forming and stronger property than a glass material.

A hinge portion 82 may be provided at the front frame 81 so as to rotatably support the auxiliary door 110. The hinge portion 82 may include an extension pin 83 that protrudes forward from the front frame 81, and a hinge pin 84 that is bent from the extension pin 83 and form a central axis for rotation of the auxiliary door 110.

The hinge portion 82 may be accommodated at an accommodating portion 121 of the auxiliary door 110. The hinge portion 82 may be provided at a lower part of the front frame 81 such that the auxiliary door 110 is rotatably and downwardly opened.

A catch portion 85 that keeps the auxiliary door 110 in a closed state unless a force exceeding a predetermined level is applied to the auxiliary door 110 may be provided at the front frame 81.

The catch portion 85 and a latch 122 of the auxiliary door 110 may interact with each other. The catch portion 85 may include an accommodating space 85*c* that accommodates a hooked-head 123 of the latch 122, a guiding side 85*a* that guides the hooked-head 123 of the latch 122 to the accommodating space 85*c*, and a hooking side 85*b* that is provided for the hooked-head 123 to be hooked to. (Refer to FIG. 8)

A locking unit accommodating portion 86 that accommodates a locking unit 95 for locking the auxiliary door 110 may be formed at the front frame 81. (Refer to FIG. 9)

The locking unit 95 is for locking the auxiliary door 110 and for preventing an unintentional opening of the auxiliary door 110 in the washing cycle of the washing machine 1 by a cause such as an internal pressure of the main body 10, pressurization by laundry, user negligence, or the like. Particularly, the bar locking unit 95 is required at the auxiliary door 110 because the auxiliary door 110 is smaller, lighter and consequently may be opened more easily than the main door 50.

Although the locking unit 95 is disposed to be spaced apart from the catch portion 85 at a lateral side of the catch portion 85 in the present embodiment, the location of the locking unit 95 is not limited. (Refer to FIG. 6)

The locking unit may be realized by various methods. As an example, the locking unit 95 may include a locking bar 96 that moves back and forth, and a driving portion 97 that provides a driving force to the locking bar 96. The driving portion 97 may include a motor (not shown) that generates rotatory power by an internal or external electric power, and a gear assembly (not shown) that converts a rotary motion to a linear motion.

The gear assembly may include various mechanical elements that may convert the rotary motion to the linear motion such as a ball screw, a rack pinion, or the like.

Further, the driving portion may be embodied not only by a motor but also by various kinds of actuators such as a hydraulic actuator, a bimetallic actuator, or the like.

The locking bar 96 may be inserted in or detached from a locking hole 128*a* that is formed at a locking protrusion 128 of the auxiliary door 110. The auxiliary door 110 may be locked when the locking bar 96 is inserted into the locking hole 128*a*, and the auxiliary door 110 may be unlocked when the locking bar 96 is removed from the locking hole 128*a*.

The door assembly 40 may include a packing member 100 that seals between the glass member 70 and the frame unit 80. The packing member 100 may be coupled to the auxiliary entrance 73 of the glass member 70. The packing member 100 may be formed by a rubber material having elasticity. Therefore, the packing member 100 may be coupled to the auxiliary entrance 73 of the glass member 70 by its own elasticity without a separate engaging member.

The auxiliary door 110 may include an auxiliary door body 120, and a door sealing member 140 that is attached to the auxiliary door body 120 so as to seal the auxiliary entrance 73 when the auxiliary door 110 is closed.

Like the glass member 70 of the main door 50, the auxiliary door body 120 may be formed by a transparent material so that the inside of the main body 10 is visible. A handle 120*a* that may be grabbed for opening and closing the auxiliary door 110 may be formed at an upper-front part of the auxiliary door body 120.

The latch 122 and the locking protrusion 128 as described above may be provided at an upper-rear part of the auxiliary door body 120. The latch 122 may be rotatably provided about a rotation axis 124, and may have the hooked-head 123 and an elastic member supporting portion 125. The hooked-head 123 may have a guiding side 123*a* that guides the hooked-head 123, and a hooking side 123*b* that is hooked by the hooking side 85*b* of the front frame 81.

The latch 122 may be elastically supported by an elastic member 126. While the auxiliary door 110 is in a closed state, when a force greater than the elastic force of the elastic member 126 is applied to the auxiliary door 110, the latch 122 is rotated to open the auxiliary door 110.

A hinge accommodating portion 121 in which the hinge portion 82 of the frame unit 80 is mounted may be formed at a lower part of a rear side of the auxiliary door 110. The hinge accommodating portion 121 may be provided such that its one side is opened for the hinge portion 82 to enter, and the opened one side of the hinge accommodating portion 121 may be covered by a hinge cover 130 after the hinge portion 82 is mounted in the hinge accommodating portion 121.

A door sealing member 140 may be formed by a rubber material having an elastic force, and may include a coupling portion 143 that is coupled to a sealing member mounting portion 129 provided at a rear side of the auxiliary door 100, a sealing contact portion 141 that contacts a sealing member contacting side 87 of the front frame 81, and a connecting portion 142 that connects the sealing contact portion 141 and the coupling portion 143.

With these configurations, through the frame unit 80 having the front frame 81 and the rear frame 91, the auxiliary door 110 may be rotatably coupled to the glass member 70 without separate processing on the glass member 70.

In addition, by coupling the auxiliary door 110 to the glass member 70 through the frame unit 80, the structure of the door assembly 40 may be simplified and weight may be reduced. As the number of components of the door assembly 40 is reduced, assembling process may be made easy, water leakage points may be reduced, and cost may be saved.

Figure 10:
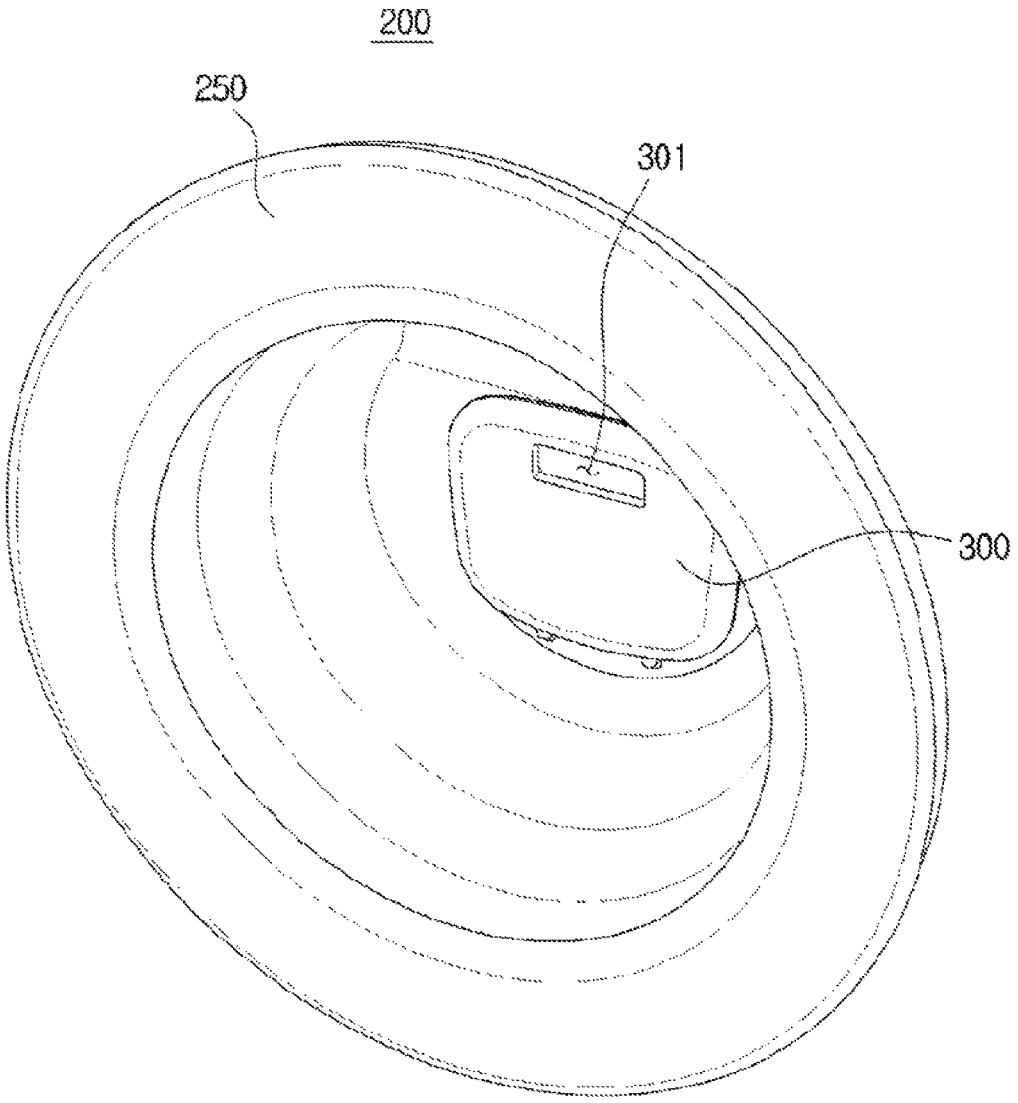
FIG. 10 is a view showing a door assembly of a washing machine according to another embodiment of the invention.
Figure 11:
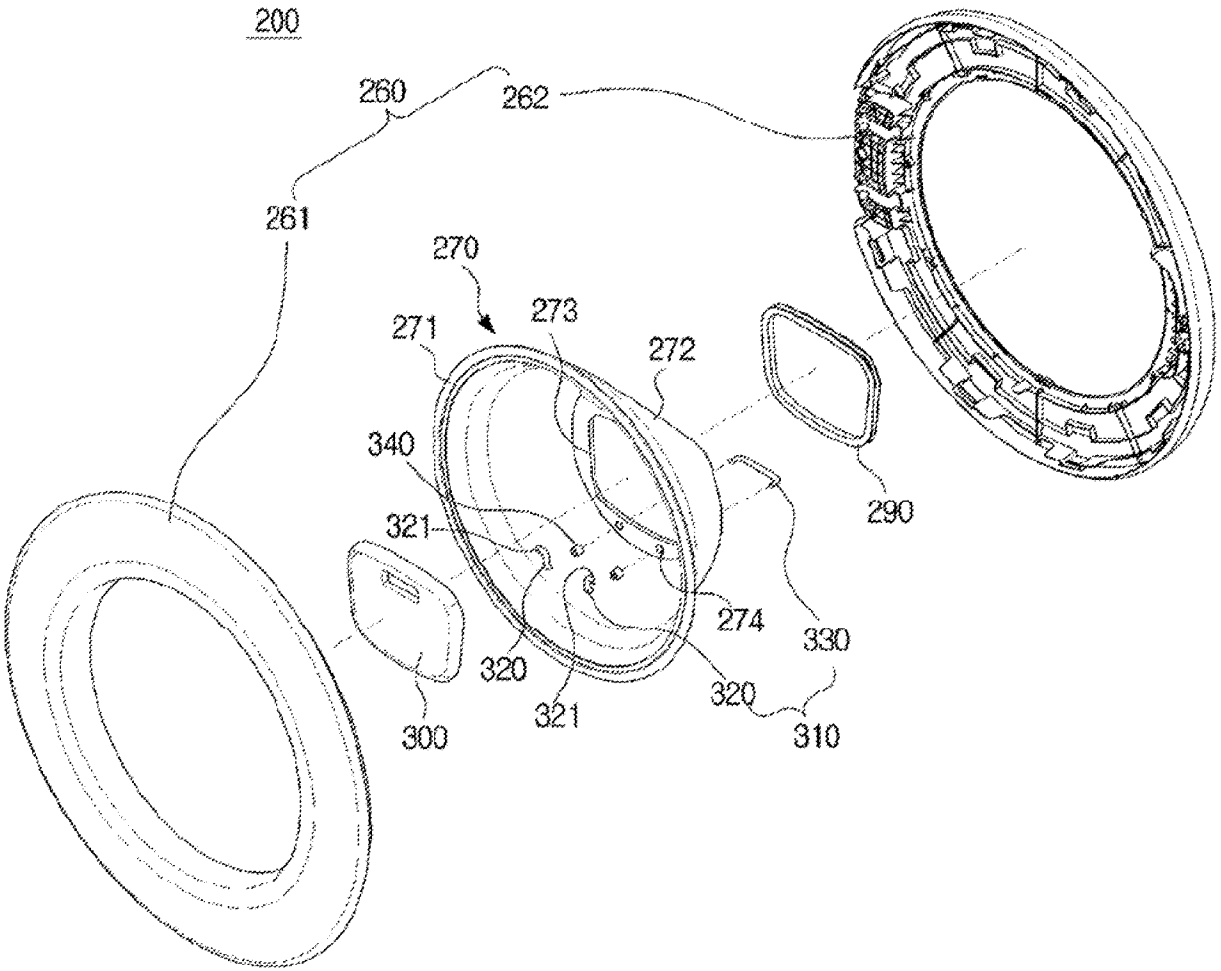
FIG. 11 is an exploded perspective view in which a door assembly of the washing machine of FIG. 10 is disassembled for illustrating a detailed configuration thereof.
Figure 12:
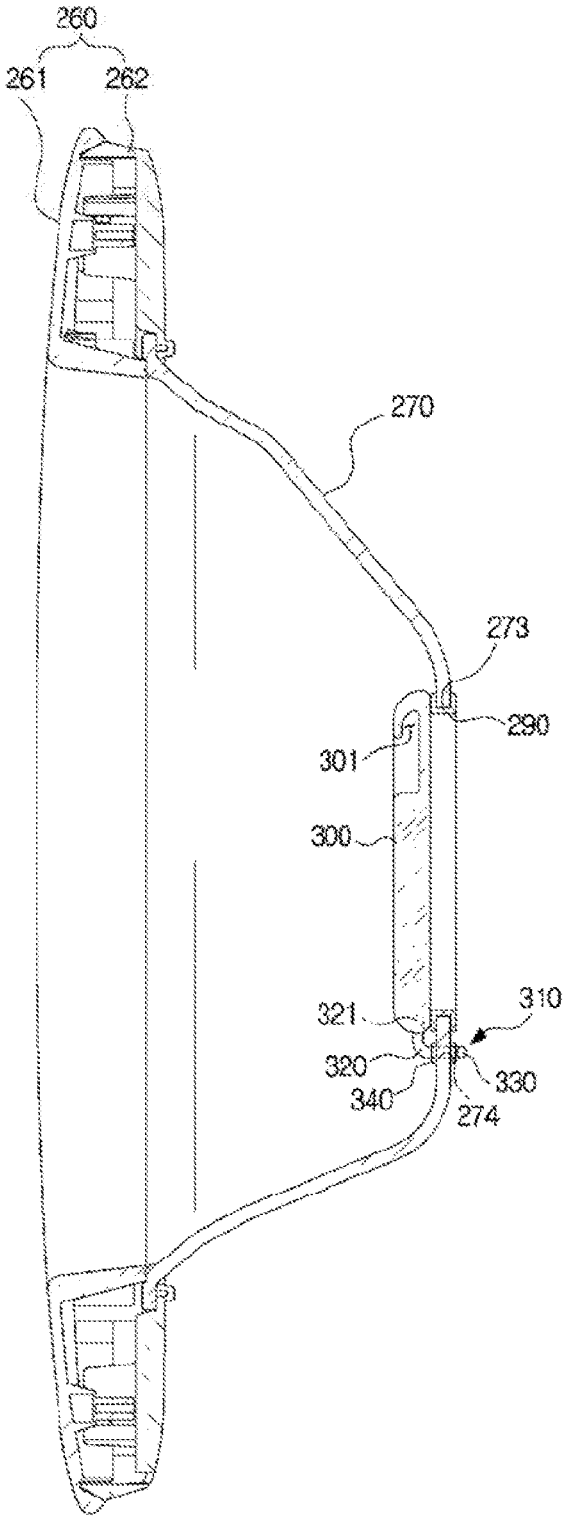
FIG. 12 is a side cross-sectional view of the door assembly of the washing machine of FIG. 10.

FIG. 10 is a view illustrating a door assembly of a washing machine according to another embodiment of the present invention. FIG. 11 is an exploded perspective view in which a door assembly of the washing machine of FIG. 10 is disassembled for illustrating a detailed configuration thereof. FIG. 12 is a side cross-sectional view of the door assembly of the washing machine of FIG. 10.

Referring to FIGS. 10 to 12, a door assembly according to another embodiment of the present invention will be described. For the same configuration as the embodiment described above, the same reference numbers will be marked and the explanation thereof may be omitted.

In the embodiment described above, the frame unit 80 is coupled to the auxiliary entrance 73, and the hinge portion 82 that rotatably supports the auxiliary door 110, the catch portion 85 that keeps the auxiliary door 110 in a closed state, and the locking unit accommodating portion 86 that accommodates the locking unit 95, and the like are provided in the frame unit 80.

Unlike the embodiment described above, a door assembly 200 according to another embodiment of the present invention may omit the frame unit 80, and a hinge member 310 and the like that rotatably support the auxiliary door 110 may be directly coupled to a glass member 270.

The door assembly 200 may include a main door 250 that opens and closes the main entrance of the front panel of the main body, and an auxiliary door 300 that opens and closes an auxiliary entrance 273 formed at the main door 250.

The main door 250 may include the glass member 270, and a holder member 260 that is coupled to an edge portion of the glass member 270 to support the glass member 270.

The glass member 270 may include a flange portion 271 that is provided at the edge portion thereof so as to be coupled to the holder member 260, and a body portion 272 that protrudes from the flange portion 271 toward the inside of the tub while the main door 250 is closed.

At the body portion 272 of the glass member 270, the auxiliary entrance 273 may be formed such that laundry may be input to an inside of the drum. A packing member 290 may be coupled to the auxiliary entrance 273 so as to closely contact the auxiliary door 300 to seal the auxiliary entrance 273 as well as simultaneously cover an inner side of the auxiliary entrance 273.

The holder member 260 that supports the glass member 270 may include a front holder member 261 and a rear holder member 262. The front holder member 261 and the rear holder member 262 may each have a ring shape. The front holder member 261 and the rear holder member 262 may be coupled to each other through an engaging member such as a screw or the like. Alternatively, the front holder member 261 and the rear holder member 262 may be integrally formed.

The auxiliary door 300 is provided for opening and closing the auxiliary entrance 273. The auxiliary door 300 may be coupled to the glass member 270 through a hinge member 310.

The hinge member 310 may include a plurality of hinge bodies 320 which have a hinge pin 321 that forms a central axis of rotation of the auxiliary door 300 and couple through the glass member 270, and a coupling body 330 that fixedly couples the plurality of hinge bodies 320 therebetween.

A through hole 274 may be provided at the glass member 270 such that the hinge bodies 320 are coupled through the glass member 270. The through hole 274 may be formed together when forming the glass member 270, or may be formed by a process such as punching or the like after the glass member 270 is once formed.

A hinge sealing member 340 may be provided at the through hole 274 to prevent a water leakage in a gap between the through hole 274 and the hinge body 320.

In the description above, although only the embodiment of coupling the hinge member 310 directly to the glass member 270 was described, a catch portion and a locking unit and the like may be directly coupled to the glass member 270 in a similar method.

According to an aspect of the present invention, a user can additionally input laundry during a washing cycle by opening and closing the auxiliary door.

According to an aspect of the present invention, since the auxiliary door is coupled to a glass member of the main door, it is possible to simplify the assembly structure, reduce the number of components, save the cost, and reduce the points of water leakage.

In addition, the door assembly can be lightened in weight and its sagging can be reduced.

Although a few embodiments have been shown and described, it would be appreciated by those skilled in the art that changes may be made in these embodiments without departing from the principles and spirit of the invention, the scope of which is defined in the claims and their equivalents.

[Description of Reference Numerals]

| | |
|---|---|
| 1: Washing Machine | 10: Main body |
| 11: Front Panel | 11a: Main Entrance |
| 12: Control Panel | 12a: Input Unit |
| 12b: Display unit | 13: Water Supply Unit |
| 13a: Water Supply Valve | 13b: Water Supply Pipe |
| 14: Detergent Supply Unit | 15: Connecting Pipe |
| 16: Driving Motor | 17: Driving Shaft |
| 18: Drain Unit | 18a: Drain Pipe |
| 18b: Drain Pump | 20: Tub |
| 21: Opening | 25: Diaphragm |
| 30: Drum | 31: Lifter |
| 32: Perforations | 40: Door Assembly |
| 41: Main Door Hinge Member | 50: Main Door |
| 60: Holder Member | 61: Front Holder Member |
| 62: Rear Holder Member | 70: Glass Member |
| 71: Flange Portion | 72: Body Portion |
| 72a: Upper Portion | 72b: Intermediate Portion |
| 72c: Lower Portion | 73: Auxiliary Entrance |
| 80: Frame Unit | 81: Front Frame |
| 82: Hinge Portion | 83: Extension Pin |
| 84: Hinge Pin | 85: Catch Portion |
| 85a: Guiding Side | 85b: Hooking Side |
| 85c: Accommodating Space | 86: Locking Unit Accommodating Portion |
| 87: Sealing Member Contacting Side | 88: Through Hole |
| 91: Rear Frame | 92: Engaging Hole |
| 95: Locking Unit | 96: Locking Bar |
| 97: Driving Portion | 100: Packing Member |
| 110: Auxiliary Door | 120: Auxiliary Door Body |
| 120a: Handle | 121: Hinge Accommodating Portion |
| 122: Latch | 123: Hooked-Head |
| 123a: Guiding Side | 123b: Hooking Side |
| 124: Rotation Axis | 125: Elasticity Member Supporting Portion |

-continued

| [Description of Reference Numerals] | |
|---|---|
| 126: Elasticity Member | 128: Locking Protrusion |
| 128b: Locking Hole | 129: Sealing Member mounting Portion |
| 130: Hinge Cover | 140: Door Sealing Member |
| 141: Sealing Contact Portion | 142: Connecting Portion |
| 143: Coupling Portion | 200: Door Assembly |
| 250: Main Door | 260: Holder Member |
| 261: Front Holder Member | 262: Rear Holder Member |
| 270: Glass Member | 271: Flange Portion |
| 272: Body Portion | 273: Auxiliary Entrance |
| 274: Through Hole | 290: Packing Member |
| 300: Auxiliary Door | 301: Handle |
| 310: Hinge Member | 320: Hinge Body |
| 321: Hinge Pin | 330: Coupling Body |
| 340: Hinge Sealing Member | S: Engaging Member |

What is claimed is:

1. A washing machine, comprising:

a main body having a main entrance provided at a front side of the main body;

a tub disposed inside the main body; and a main door configured to open and close, respectively, the main entrance, the main door including a holder member, a glass member including a flange portion coupled to the holder member so that the glass member is supported by the holder member, a body portion that, while the main door is closed, protrudes toward an inside of the tub, and an auxiliary entrance provided at the body portion to input laundry inside the tub while the main door is closed;

an auxiliary door that opens and closes the auxiliary entrance;

a frame unit coupled to the glass member to frame the auxiliary entrance; and a packing member coupled to the glass member to provide a seal between the glass member and the frame unit.

2. The washing machine of claim 1, wherein the auxiliary door rotates to open and close the auxiliary entrance.

3. The washing machine of claim 1, wherein the frame unit includes a hinge portion rotatably supporting the auxiliary door so that the auxiliary door rotates to open and close the auxiliary entrance.

4. The washing machine of claim 1, wherein the frame unit includes:

a catch portion that, while the auxiliary door closes the auxiliary entrance, keeps the auxiliary door in a closed state unless a force exceeding a predetermined level is applied to the auxiliary door.

5. The washing machine of claim 1, wherein the frame unit includes:

a front frame at a front side of the glass member, and a rear frame at a rear side of the glass member and coupled to the front frame.

6. The washing machine of claim 5, further comprising:

an engaging member that couples the front frame and the rear frame together.

7. The washing machine of claim 1, further comprising a locking unit that locks the auxiliary door in a closed state.

8. The washing machine of claim 1, wherein the auxiliary door includes a sealing member that closely contacts the frame unit.

9. The washing machine of claim 1, further comprising:

a hinge member coupled to the glass member to support the auxiliary door so that the auxiliary door rotates to open and close the auxiliary entrance.

10. The washing machine of claim 9, wherein a through hole is formed in the glass member to couple with the hinge member.

11. A washing machine comprising:

a main body having a main entrance provided at a front side of the main body;

a tub disposed inside the main body; and a main door configured to open and close, respectively, the main entrance, the main door including a holder member, a glass member including a flange portion coupled to the holder member so that the glass member is supported by the holder member, a body portion that, while the main door is closed, protrudes toward an inside of the tub, the body portion including a slanted upper portion, a slanted lower portion, and an intermediate portion that is vertically arranged between the slanted upper portion and the slanted lower portion, and an auxiliary entrance provided at the intermediate portion of the body portion to input laundry inside the tub while the main door is closed.

12. A washing machine comprising:

a main body having a main entrance provided at a front side of the main body;

a tub disposed inside the main body; and a door assembly including a main door configured to open and close, respectively, the main entrance, a holder member, a glass member including a flange portion coupled to the holder member so that the glass member is supported by the holder member, a body portion that, while the main door is closed, protrudes toward an inside of the tub, and an auxiliary entrance disposed in the body portion to input laundry inside the tub while the main door is closed;

an auxiliary door to open and close the auxiliary entrance; and a frame unit including a front frame at a front side of the glass member, and a rear frame at a rear side of the glass member and coupled to the front frame, so that the frame unit thereby frames the auxiliary entrance.

13. The washing machine of claim 12, wherein the door assembly further comprises:

a hinge that rotatably supports the auxiliary door so that the auxiliary door rotates to open and close the auxiliary entrance.

* * * * *